US007730917B2

(12) United States Patent
Hui

(10) Patent No.: US 7,730,917 B2
(45) Date of Patent: Jun. 8, 2010

(54) APPARATUS FOR CARD RECEIVAL AND WALLET WITH THE SAME

(76) Inventor: Pei Hang Hui, Rm 1505 (1504.7.8) South China Ind. Bldg No. 1, Chun Pin Street, Kwai Chung, New Territories, Hong Kong (HK)

( * ) Notice: Subject to any disclaimer, the term of this patent is extended or adjusted under 35 U.S.C. 154(b) by 851 days.

(21) Appl. No.: 11/153,485

(22) Filed: Jun. 16, 2005

(65) Prior Publication Data

US 2006/0108036 A1 May 25, 2006

(30) Foreign Application Priority Data

Nov. 19, 2004 (CN) ..... 2004 2 00953381 U

(51) Int. Cl.
*A45C 1/06* (2006.01)

(52) U.S. Cl. ..... 150/138; 150/147; 150/132; 150/136

(58) Field of Classification Search ..... 150/147–149, 150/112–116, 127, 131, 132, 144; 206/39.3, 206/39.7, 37
See application file for complete search history.

(56) References Cited

U.S. PATENT DOCUMENTS

| | | | | | |
|---|---|---|---|---|---|
| 155,448 | A | * | 9/1874 | Jasmagy | 150/112 |
| 453,823 | A | * | 6/1891 | Weidemann | 150/117 |
| 693,295 | A | * | 2/1902 | Scheuer | 472/34 |
| 722,295 | A | * | 3/1903 | Gaisman | 150/117 |
| 3,536,116 | A | * | 10/1970 | Margolis | 150/103 |
| 3,856,063 | A | * | 12/1974 | Dengel | 150/132 |

* cited by examiner

*Primary Examiner*—Tri M Mai

(57) ABSTRACT

An apparatus for card receival comprises a foldaway portion; a leather element; and two fence elements; wherein the foldaway portion has its two ends to connect with the two ends of the leather element; the two fence elements connecting with the foldaway portion by one side thereof; the leather element comprising a plurality of card receival units, each of which constituting by a plurality of bar openings for cards inserting. As an embodiment, the card receival units are arranged at intervals. The apparatus for card receival may further comprise a coin-receiving bag formed on an outer side of the foldaway portion. The invention also discloses a wallet with such an apparatus for card receival.

6 Claims, 9 Drawing Sheets

APPARATUS FOR CARD RECEIVAL AND WALLET WITH THE SAME

FIELD OF THE INVENTION

The present invention relates to a wallet, particularly to an apparatus for card receival used in wallets (or called billfold, notebooks, handbooks).

BACKGROUND OF THE INVENTION

At present, referring to FIGS. 1-4, some conventional apparatus for card receival 1 are commonly set in all kinds of wallets (billfolds, notebooks or handbooks). Referring to FIGS. 5-7, as an example, a conventional apparatus for card receival 1 consists of several card receival units, which are stepwisely overlapped together one by one. In the card receival units, each of which consists of a husk 12 and a liner 13 except that one outer card receival unit 11 is made from a piece of overall leather. In the prior art, the husk 12 is jointed to a top edge of the liner 13 to form an inner card receival unit. Then, the so-formed inner card receival units and the outer card receival unit 11 are stepwisely overlapped together by layer to form an apparatus for card receival. One of the card receival units has its bottom edge is glued to the liner 13 of another card receival unit adjacent thereto. Finally, the apparatus for card receival is connected to a main body of a wallet by sewing its outer rim 14 thereto. Generally, the husks 12 are made of leather material to improve its lifespan, while the liners 13 are made of filmy material for dividing the card receival units and avoiding overthickness of the overlapped card receival units.

However, the conventional apparatus for card receival has a complicate structure which results in a higher manufacture cost and time waste. In addition, the liners are easily worn during usage so that the card receival units are in a non-division state, and then the cards received in an upper layer will drop to an lower layer of the apparatus for card receival. Thus, a function of the apparatus for card receival is lost. Furthermore, the apparatus for card receival can not show the information of the cards therein clearly so that it is rather a waste of time to find a desired card in the apparatus for card receival.

Hence it is desired to provide an apparatus for card receival which can overcome the foregoing drawbacks of the prior art.

SUMMARY OF THE INVENTION

A main object of the present invention is to provide an apparatus for card receival, which has a simple structure and a big capacity, and also is easy to find desired card in the apparatus for card receival.

Another object of the present invention is to provide a wallet with such an apparatus for card receival.

To attain the object of the present invention, an apparatus for card receival comprises a foldaway portion; a leather element; and two fence elements; wherein the foldaway portion has its two ends to connect with the two ends of the leather element; the two fence elements connecting with the foldaway portion by one side thereof; the leather element comprising a plurality of card receival units, each of which constituting by a plurality of bar openings for cards inserting. As an embodiment, the card receival units are arranged at intervals. The apparatus for card receival may further comprise a coin-receiving bag formed on an outer side of the foldaway portion.

A wallet of the present invention comprises a wallet body; and an apparatus for card receival; wherein the apparatus for card receival comprising: a foldaway portion; a leather element; and two fence element; wherein the foldaway portion has its two ends to connect with the two ends of the leather element; the two fence elements connecting with the foldaway portion by one side thereof; the leather element comprising a plurality of card receival units, each of which constituting by a plurality of bar openings for cards inserting. As an embodiment, the card receival units are arranged at intervals. The wallet may further comprise a coin-receiving bag formed on an outer side of the foldaway portion.

For the purpose of making the invention easier to understand, some particular embodiments thereof will now be described with reference to the appended drawings in which:

DETAILED DESCRIPTION OF THE INVENTION

Figure 1:
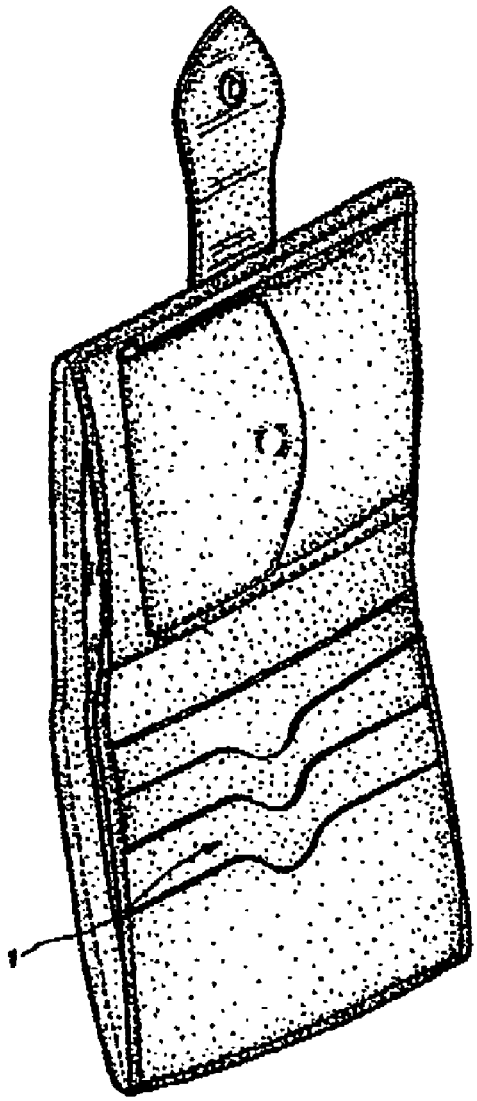
FIG.1 (PRIOR ART)
FIGS. 1-4 are schematic views of four different conventional apparatus for card receival.
Figure 2:
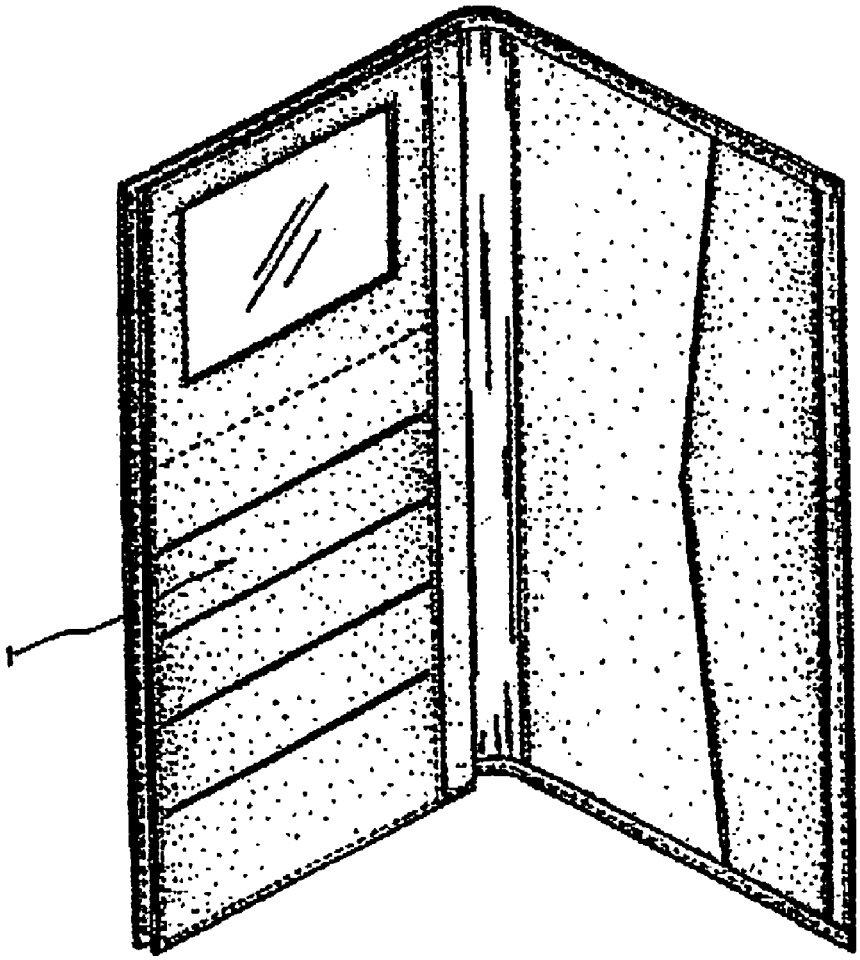
FIG.2 (PRIOR ART)
Figure 3:
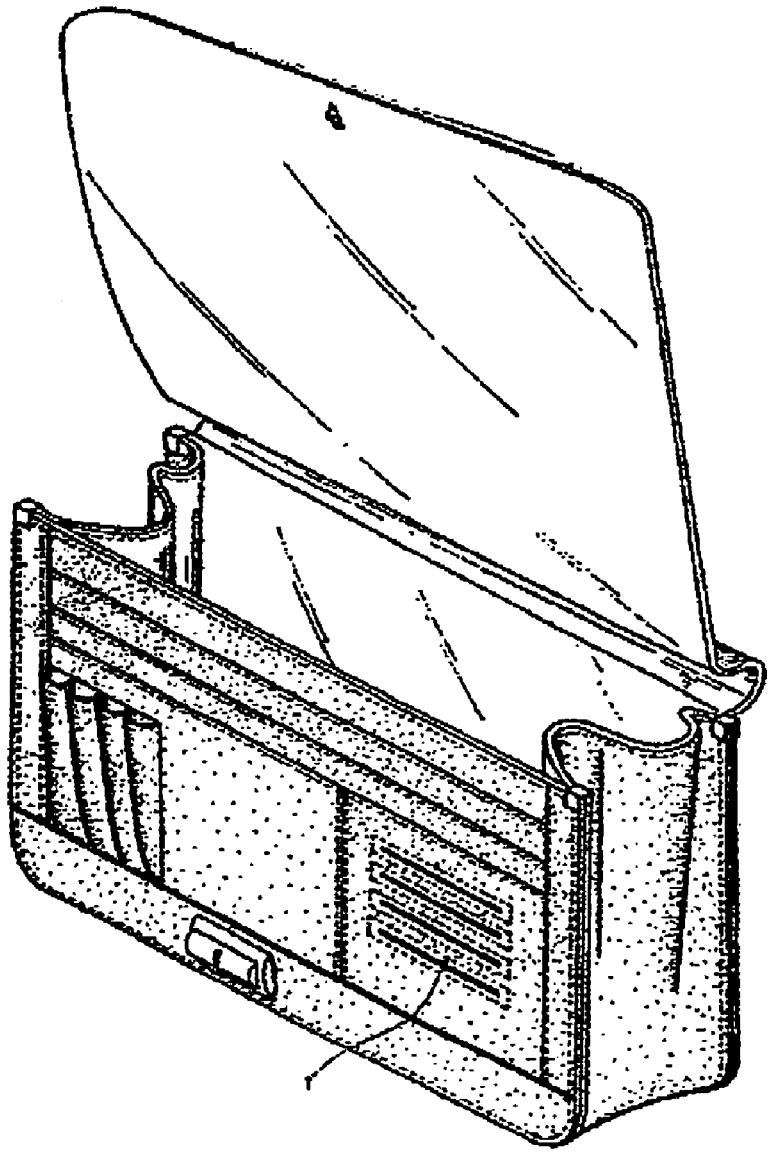
FIG.3 (PRIOR ART)
Figure 4:
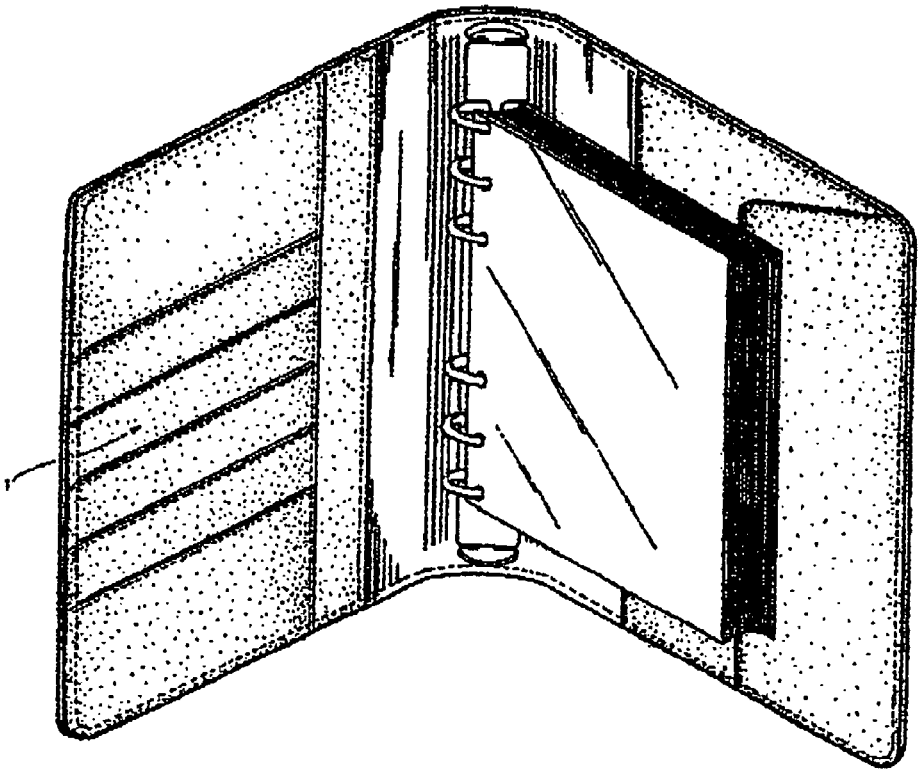
FIG.4 (PRIOR ART)
Figure 5:
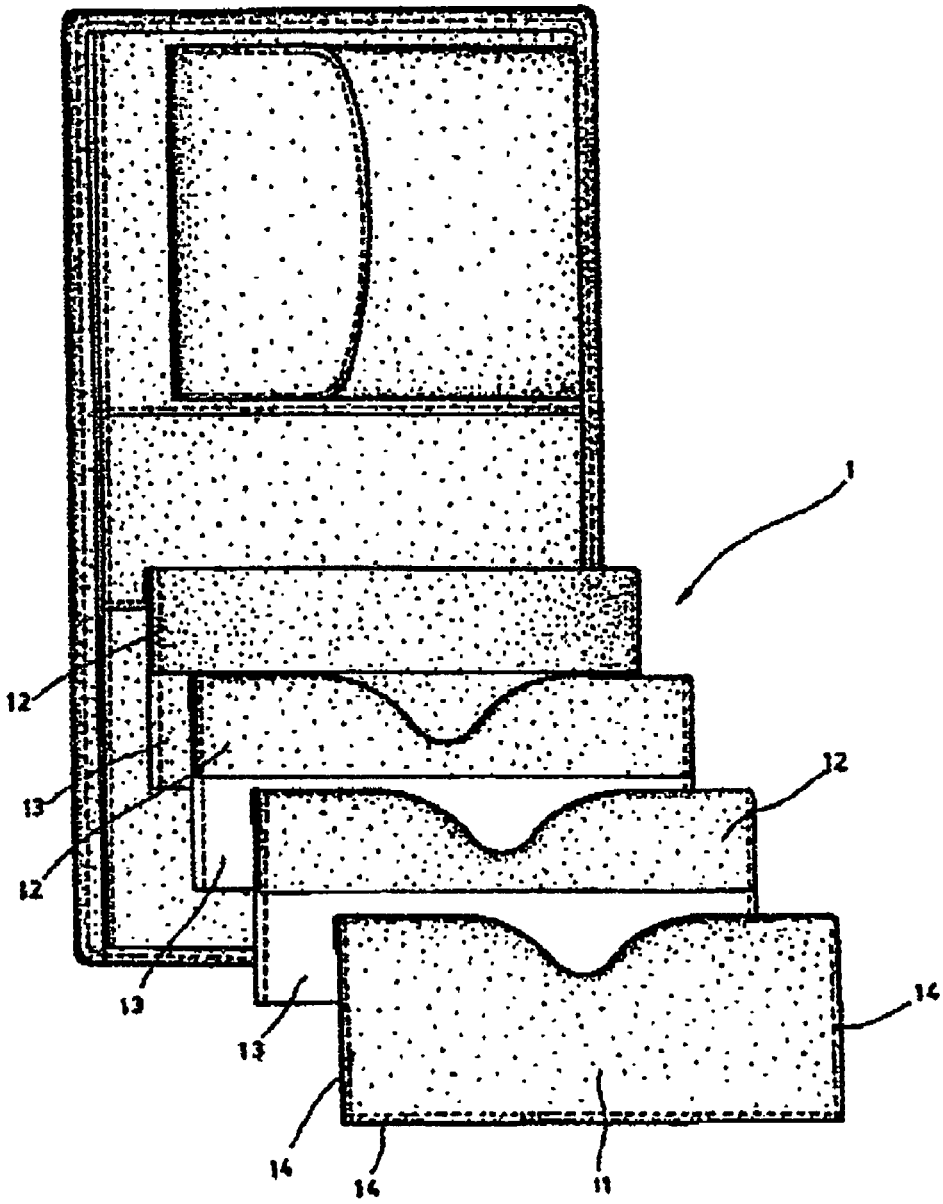
FIG.5 (PRIOR ART)
FIGS. 5-7 are schematic views to show a structure of another conventional apparatus for card receival.
Figure 6:
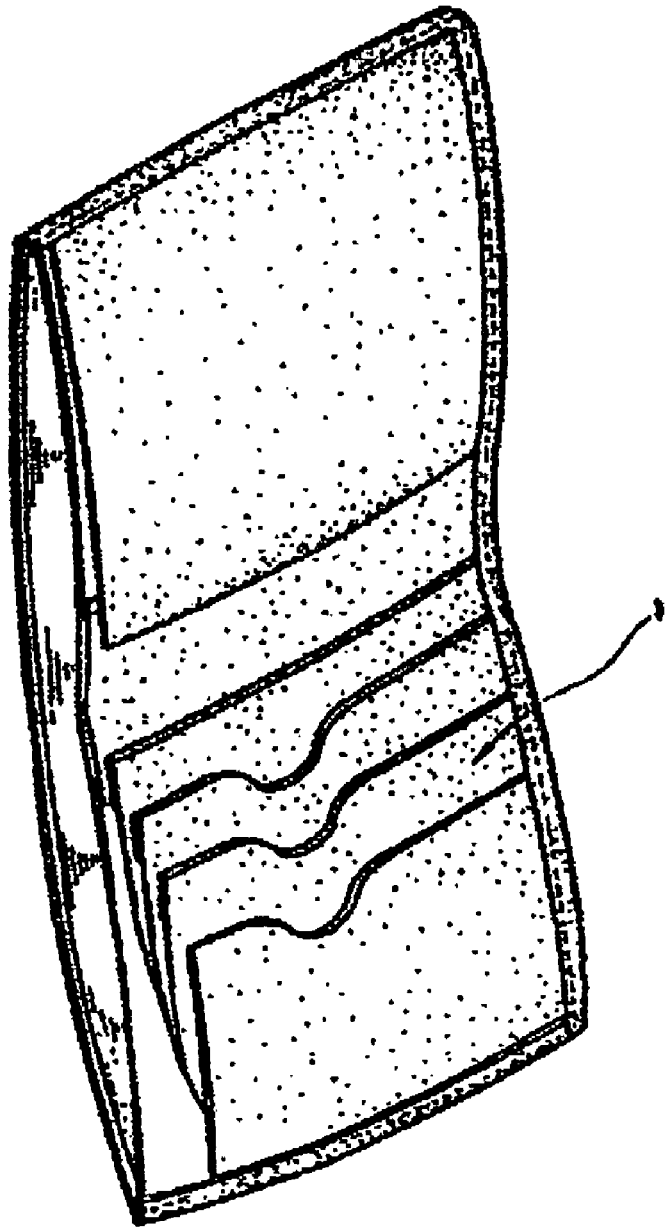
FIG.6 (PRIOR ART)
Figure 7:
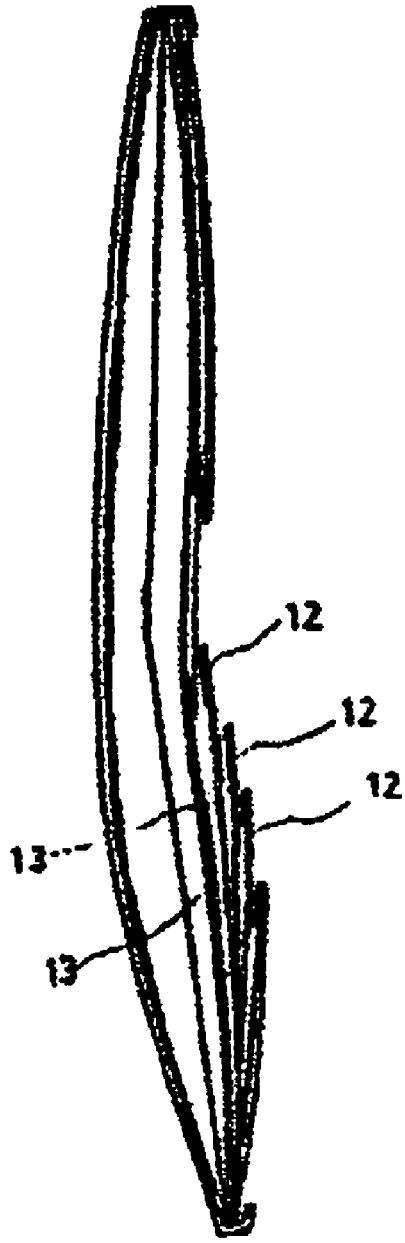
FIG.7 (PRIOR ART)
Figure 8:
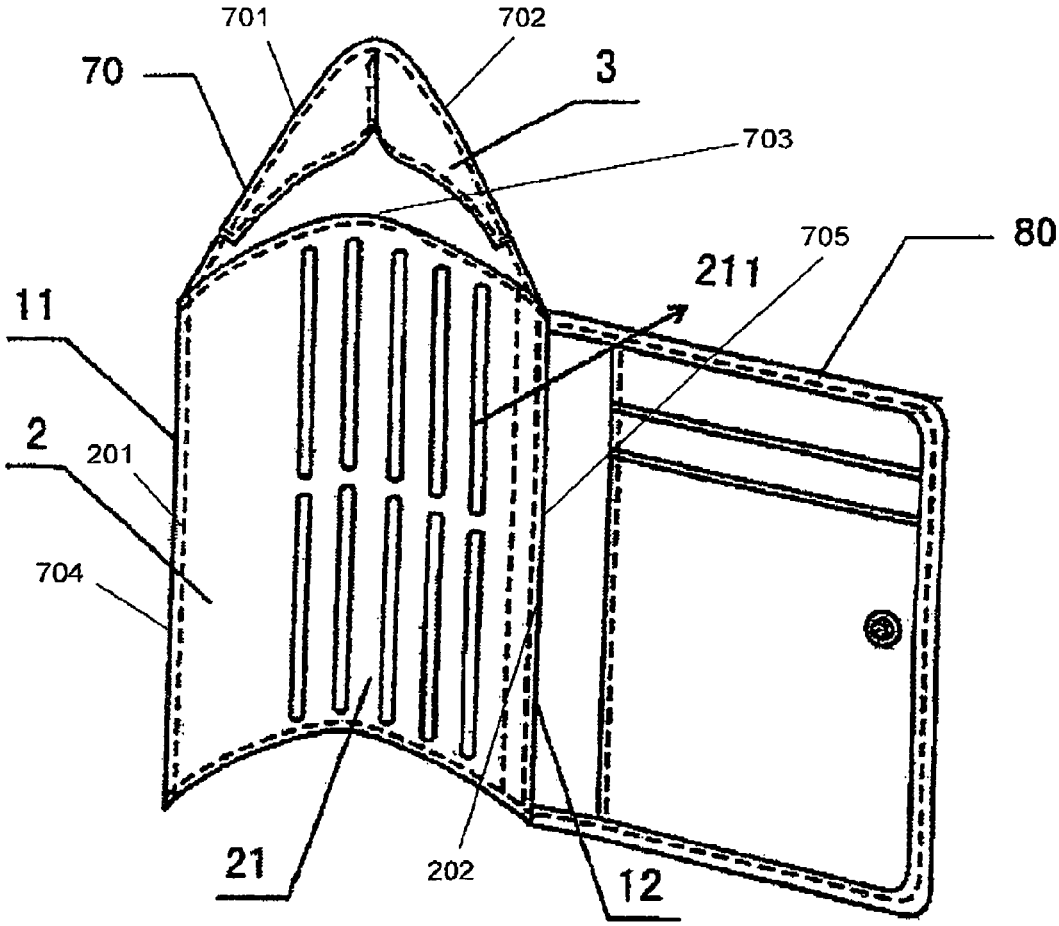
FIG. 8 is a structural schematic view of an apparatus for card receival of the invention before cards are received.
Figure 9:
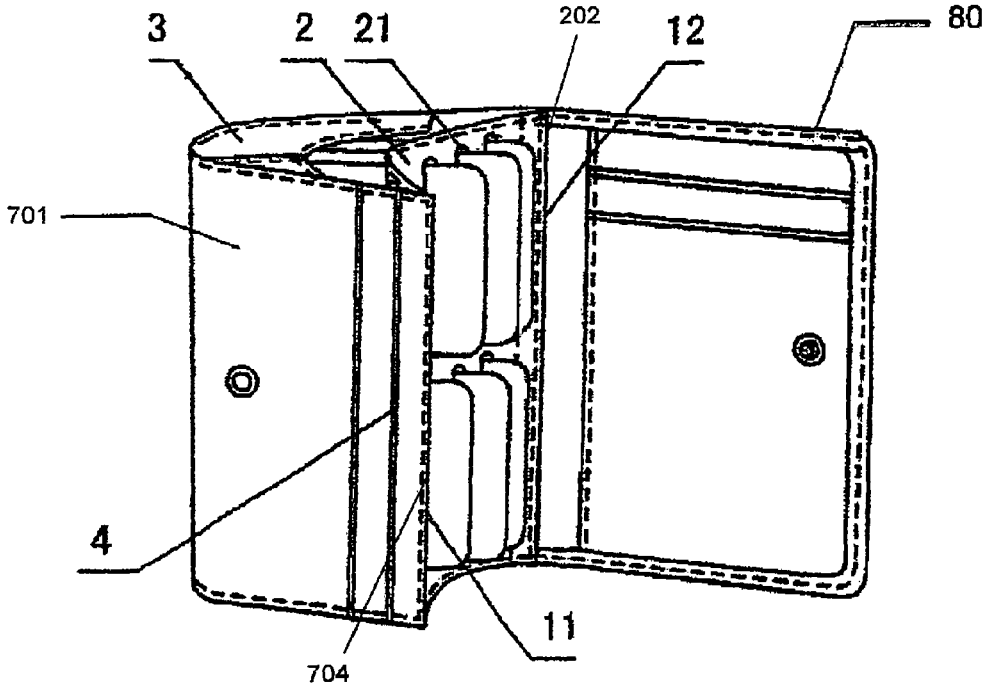
FIG. 9 is a structural schematic view of the apparatus for card receival after cards are received.

Referring now to the drawings in detail, as shown in FIGS. 8-9, according to an embodiment of the invention, an apparatus for card receival comprises a foldaway portion 70, a single-layer leather element 2, and two fence elements 3. The foldaway portion 70 has its two ends to connect with the two ends of the leather element 2. The two fence elements 3 connects with the foldaway portion 70 by one side thereof. The foldaway portion 70, a single-layer leather element 2, and two fence elements 3 constitute a recipient to receive cards (not labeled).

Referring to FIGS. 8-9, the foldaway portion 70 is in form of a V-shaped pocket comprising a first surface 701, a second surface 702 opposite to the first surface 701, and a top opening 703. The leather element 2 is disposed with a first edge 201 and a second edge 202 opposite to the first edge 201, and the first edge 201 connects to a top edge 704 of the first surface 701 of the foldaway portion 70 and the second edge 202 connects to a top edge 705 of the second surface 702 of the foldaway portion 7, so that the leather element 2 covers the top opening 703 of the V-shaped pocket of the foldaway portion 70.

In the present invention, referring to FIGS. 8-9, the leather elements 2 comprises a plurality of card receival units 21 which are formed directly in the leather element 2. The card receival units 21 are arranged at intervals, each of which is constituted by a plurality of bar openings 211. The bar openings 211 can be designed according to actural requirement, which is convenient for card inserting.

According to a further embodiment of the invention, referring to FIGS. 8-9, a coin-receiving bag 4 can be formed on an outer side of the foldaway portion 70 to receive coins. Understandably, the apparatus for card receival can be connected to a wallet body 80 by one connecting end 12 of the foldaway portion 70 with the leather element 2 to constitute a wallet (billfolds, notebooks or handbooks).

Comparing with the prior art, because the card receival units 21 are formed from a single-layer leather element 2, so it greatly reduces the manufacturing cost and occupy a little space when being folded. In addition, the bar openings 211 are very convenient for card inserting and the information on any of the cards can show clearly to user when the wallet is unwraped, thus the user can find the desired card easily. Also, the card receival units 21 are only constituted by the bar openings 211, so it has a big capacity to receive cards. Furthermore, the coin-receiving bag 4 is convenient for receiving coins.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An apparatus for card receival comprising:

a foldaway portion in form of a V-shaped pocket comprising a first surface, a second surface a opposite to the first surface, and a top opening;

a leather element with a first edge and a second edge opposite to the first edge, and the first edge connects to a top edge of the first surface of the foldaway portion and the second edge connects to a top edge of the second surface of the foldaway portion, so that the leather element covers the top opening of the V-shaped pocket of the foldaway portion; and two fence elements; wherein the two fence elements connecting with the foldaway portion by one side thereof;

the leather element comprising a plurality of card receival units, each of which constituting by a plurality of bar openings for cards inserting.

2. The apparatus for card receival as claimed in claim 1, wherein the card receival units are arranged at intervals.

3. The apparatus for card receival as claimed in claim 2, further comprising a coin-receiving bag formed on an outer side of the foldaway portion.

4. A wallet comprising:

a wallet body; and an apparatus for card receival;

wherein the apparatus for card receival comprising:

a foldaway portion in form of a V-shaped pocket comprising a first surface, a second surface opposite to the first surface, and a top opening;

a leather element with a first edge and a second edge opposite to the first edge, and the first edge connects to a top edge of the first surface of the foldaway portion and the second edge connects to a top edge of the second surface of the foldaway portion, so that the leather element covers the top opening of the V-shaped pocket of the foldawav portion; and two fence elements; wherein the two fence elements connecting with the foldaway portion by one side thereof;

the leather element comprising a plurality of card receival units, each of which constituting by a plurality of bar openings for cards inserting.

5. The wallet as claimed in claim 4, wherein the card receival units are arranged at intervals.

6. The wallet as claimed in claim 5, further comprising a coin-receiving bag formed on an outer side of the foldaway portion.

* * * * *